US011737536B2

(12) United States Patent
Fitzsimmons

(10) Patent No.: US 11,737,536 B2
(45) Date of Patent: Aug. 29, 2023

(54) FABRIC ORGANIZER WITH CLIPBOARD

(71) Applicant: Carl Fitzsimmons, Webster, NY (US)

(72) Inventor: Carl Fitzsimmons, Webster, NY (US)

( * ) Notice: Subject to any disclaimer, the term of this patent is extended or adjusted under 35 U.S.C. 154(b) by 93 days.

(21) Appl. No.: 17/163,399

(22) Filed: Jan. 30, 2021

(65) Prior Publication Data

US 2021/0235830 A1 Aug. 5, 2021

Related U.S. Application Data

(60) Provisional application No. 62/967,789, filed on Jan. 30, 2020.

(51) Int. Cl.

| | |
|---|---|
| ***A45C 13/02*** | (2006.01) |
| ***A45C 13/10*** | (2006.01) |
| ***A45C 13/12*** | (2006.01) |
| ***A45C 11/00*** | (2006.01) |

(52) U.S. Cl.

CPC ..... *A45C 13/02* (2013.01); *A45C 13/1046* (2013.01); *A45C 13/12* (2013.01); *A45C 2011/002* (2013.01); *A45C 2011/003* (2013.01); *A45C 2013/025* (2013.01); *A45C 2013/1015* (2013.01)

(58) Field of Classification Search

CPC ..... A45C 13/02; A45C 13/1046; A45C 13/12; A45C 2011/002; A45C 2011/003; A45C 2013/025; A45C 2013/1015

USPC ..... 206/305, 320, 37

See application file for complete search history.

(56) References Cited

U.S. PATENT DOCUMENTS

| | | | | | |
|---|---|---|---|---|---|
| 5,160,001 | A * | 11/1992 | Marceau | G06F 1/1628 | 190/902 |
| 5,950,826 | A * | 9/1999 | Lykowski | A45D 1/00 | 206/349 |
| 6,068,122 | A * | 5/2000 | Burns | A45D 1/00 | 206/372 |
| 6,296,094 | B1 * | 10/2001 | Knecht | A45C 7/0095 | 206/281 |
| 6,578,706 | B2 * | 6/2003 | Thompson | A45C 7/0095 | 206/214 |
| 6,604,618 | B1 * | 8/2003 | Godshaw | G06F 1/1628 | 206/320 |
| 7,055,682 | B1 * | 6/2006 | Domotor | A45C 13/02 | 206/214 |
| 8,567,578 | B2 * | 10/2013 | Cuong | A45C 13/24 | 190/110 |
| 10,183,628 | B2 * | 1/2019 | Mea | A45F 5/00 | |
| 2003/0192759 | A1 * | 10/2003 | Godshaw | A45C 3/02 | 190/107 |
| 2004/0031655 | A1 * | 2/2004 | Milionta | A45C 13/02 | 190/110 |
| 2004/0099496 | A1 * | 5/2004 | Hollingsworth | A45C 3/02 | 150/112 |

(Continued)

*Primary Examiner* — Chun Hoi Cheung

(74) *Attorney, Agent, or Firm* — Duane C. Basch; Dawson Law Firm, PC

(57) ABSTRACT

Disclosed is an organizer, comprising a fabric folded to form multiple overlapping layers, to form at least one slot for receiving a clipboard or similar rigid panel, the fabric being further joined along opposing edges between other layers to form a pocket, and a layer providing a cove. Additional options include a mechanism (e.g., hook-and-loop, snap, elastic cord, button, clasp, zipper, etc.) for holding the cover layer in position.

11 Claims, 9 Drawing Sheets

(56) References Cited

U.S. PATENT DOCUMENTS

| | | | | |
|---|---|---|---|---|
| 2009/0173648 | A1* | 7/2009 | Geneva | A45C 11/008 206/349 |
| 2013/0221048 | A1* | 8/2013 | Revels | A45F 3/02 224/601 |
| 2018/0103744 | A1* | 4/2018 | Moore | A45D 1/00 |

* cited by examiner

FABRIC ORGANIZER WITH CLIPBOARD

This application claims priority under 35 U.S.C. § 119 to U.S. Provisional Patent Application No. 62/967,789 for a FABRIC ORGANIZER WITH CLIPBOARD, by Carl Fitzsimmons, filed Jan. 30, 2020, which is hereby incorporated by reference in its entirety.

A clipboard-based organizer apparatus is constructed with a configurable fabric cover that allows the user to adjust and customize aspects of the organizer for personal preferences and uses. The customizable organizer is made, in one embodiment, with a single piece of fabric so as to reduce material and manufacturing costs.

BACKGROUND AND SUMMARY

When a person is engaged in in-person canvassing, surveying, interviewing or going door to door for various political, fund raising, census, or other data gathering needs there is always some form of printed material the person needs to have available for sharing, signatures, etc. Such a person may also have a connected small smart device to manage. Canvassers, for example, may also need to have a person fill out a form or sign a petition. With other notebooks, clipboards and the like it is very difficult to hold onto all of the materials a canvasser has at one time. The disclosed embodiments not only provide adequate and easily accessible pockets, surfaces and even mounts tablets and similar electronic devices, but can also provide protection from weather that could damage printed materials or electronic devices.

Previously, others have used clipboards, clipboard folders or simply folders and envelopes to try and organize and contain the various materials that are carried during canvassing, interviewing and the like. However, such prior solutions have a limited capability to hold multiple printed items and/or electronic devices, and they are difficult to hold together, manage or readily access. It is also difficult, at best, to hold such items while providing a writing surface upon which the subject can fill out a form or sign a petition at the same time. When using folders, clipboards and envelopes, a canvasser typically has to shuffle printed material or electronic device or switch between both during a contact or interview period with the subject.

Disclosed in embodiments herein is an organizer, comprising: a fabric folded to form at least four overlapping layers, where at least a short edge of a first of the four layers is connected to a second of the four layers to form at least one slot, said fabric being further joined along opposing edges between the second of the four layers and a third of the four layers to form a pocket between the second and third of the four layers, and where a fourth of the four layers provides a cover over the second of the four layers; a mechanism (e.g., hook-and-loop, snap, elastic cord, button, clasp, zipper, etc.) for holding said fourth of the four layers in position as a movable cover over the second of the four layers; and a clipboard or other rigid surface for removable insertion into the at least one slot for providing a rigid surface about which the folded fabric layers may be employed.

Figure 1:
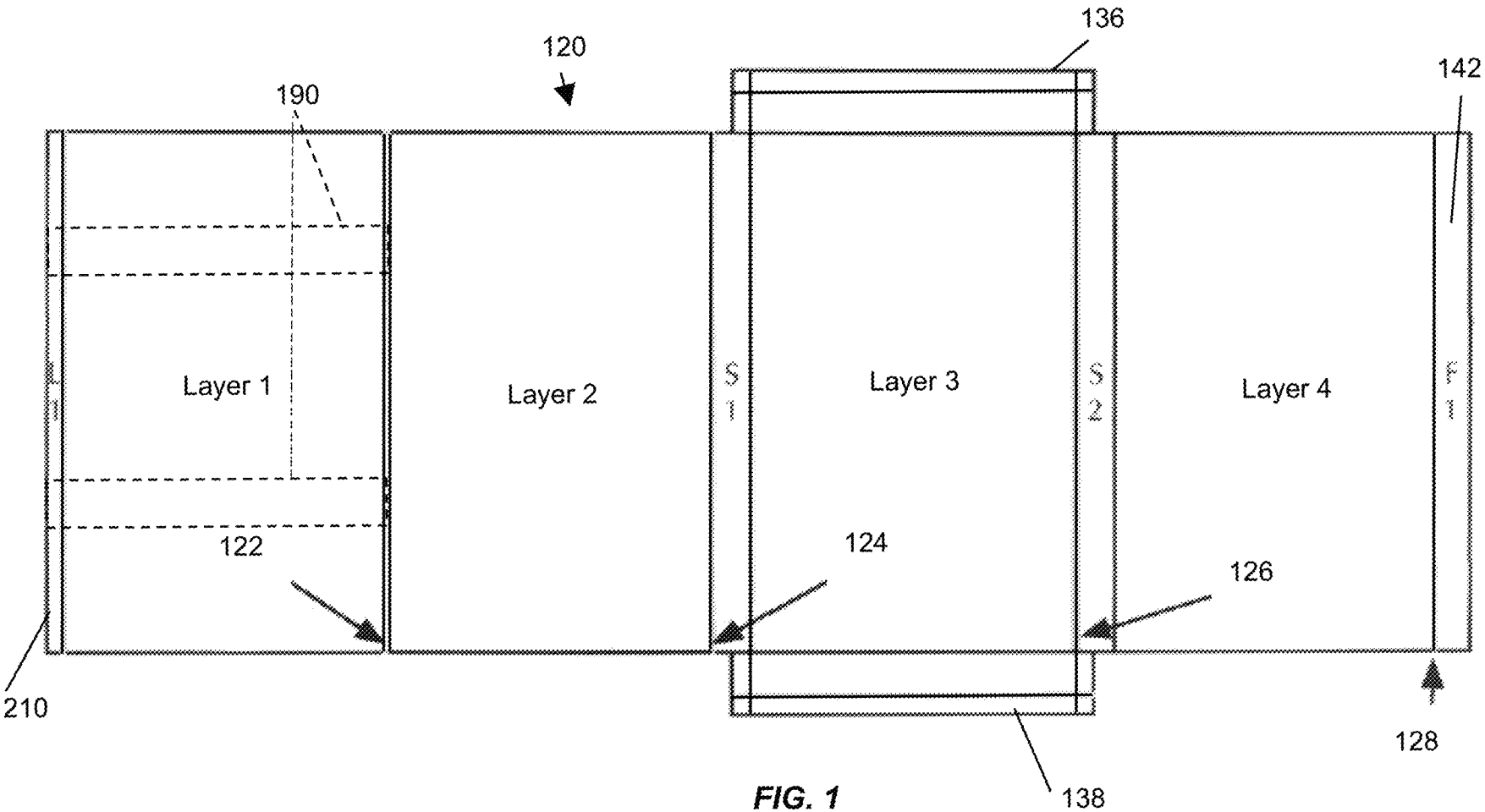
FIG. 1 is a top view of a fabric "pattern" for construction of one embodiment of an organizer.

The various embodiments described herein are not intended to limit the disclosure to those embodiments described. On the contrary, the intent is to cover all alternatives, modifications, and equivalents as may be included within the spirit and scope of the various embodiments and equivalents set forth. For a general understanding, reference is made to the drawings. In the drawings, like references have been used throughout to designate identical or similar elements. It is also noted that the drawings may not have been drawn to scale and that certain regions may have been purposely drawn disproportionately so that the features and aspects could be properly depicted.

DETAILED DESCRIPTION

Referring to the figures, disclosed herein are embodiments of a fabric organizer with clipboard that may be employed by a person for campaigning, interviewing, survey research, and various data gathering needs requiring multiple items to be carried while needing a platform to write a response or record that response using an electronic device while maintaining the ability to protect against weather so as to avoid impacting paper items and an electronic device(s). For example, and advantage of the disclosed organizer is that it Addresses organizing of printed materials for easy retrieval while campaigning, interviewing or engaged in various contact needs thus enabling the interviewer the opportunity to free up a hand from the task of holding such materials and devices.

Referring to FIGS. 1-3C, the following reference numerals have been used to characterize the general components:

100—clipboard (e.g., letter, legal, or European (A4) size);

120—fabric(s) or textile material(s), where the fabric(s) may be natural or synthetic, and have characteristics such as water resilient, water proof, not water resilient or water proof;

122, 124, 126, 128—folds, used to form overlapping layers

130—fastener (e.g., hook and loop (Velcro®), snap(s), button(s), etc.);

136, 138—end pieces, and

140—elastic closure band.

Although not expressly shown, it is contemplated that the exposed (unsewn or unseemed) edges of the fabric organizer may be serged, overcast-sewn, treated with a sewing glue or otherwise be covered with an edging material.

In the embodiment depicted in the figures, the organizer 90, comprises a fabric 120 folded at 122, 124, 126 and 128 to form at least four overlapping layers (Layers 1-4), where at least a short portion of edge 210 along Layer 1 is connected via sewing, heat-sealing, gluing or the like to Layer 2 to form at least one slot 220 between the adjoining layers. The fabric 120 is further joined along opposing edges between Layer 2 and Layer 3 to form a pocket 230 between the second and third layers. Finally, Layer 4 provides a cover 240 overlapping Layer 2, and may extend around the edge or side of the organizer as indicated by flap F1 and 142.

A holding or fastening mechanism 140, such as a hook-and-loop type fastener(s), a snap(s), an elastic cord, a button(s), a clasp(s), a zipper, etc. may be employed for holding the flap (F1 and 142) of Layer 4 in position. As illustrated in the various configurations of FIGS. 4-11, cover 240 is a movable cover that overlaps or covers Layer 2.

Also included in the organizer 90 is a clipboard 100 or other rigid surface for removable insertion into the at least one slot 220 for providing a rigid surface about which the folded fabric layers may be employed to provide not only storage spaces but other functional components such as a writing surface, etc.

As depicted in FIGS. 3A-3C and 4-11, the organizer slot 220 is open along at least one and possibly both of the opposed sides 224 and 224 of Layers 1 and 2, to allow insertion of the clipboard or other rigid surface therein from one or either side so as to make the organizer customizable for use from either side (e.g., left- or right-handed user).

As set forth in FIGS. 6-11 an outer surface of Layer 2 includes a component 130, 250 facilitating the attachment of a tablet 252, smart phone, or similar device thereto. Furthermore, the component facilitating attachment may include one or more of hook-and-loop fasteners, a fabric flap, a fabric pocket having a window for access to the device, etc.

Figure 2:
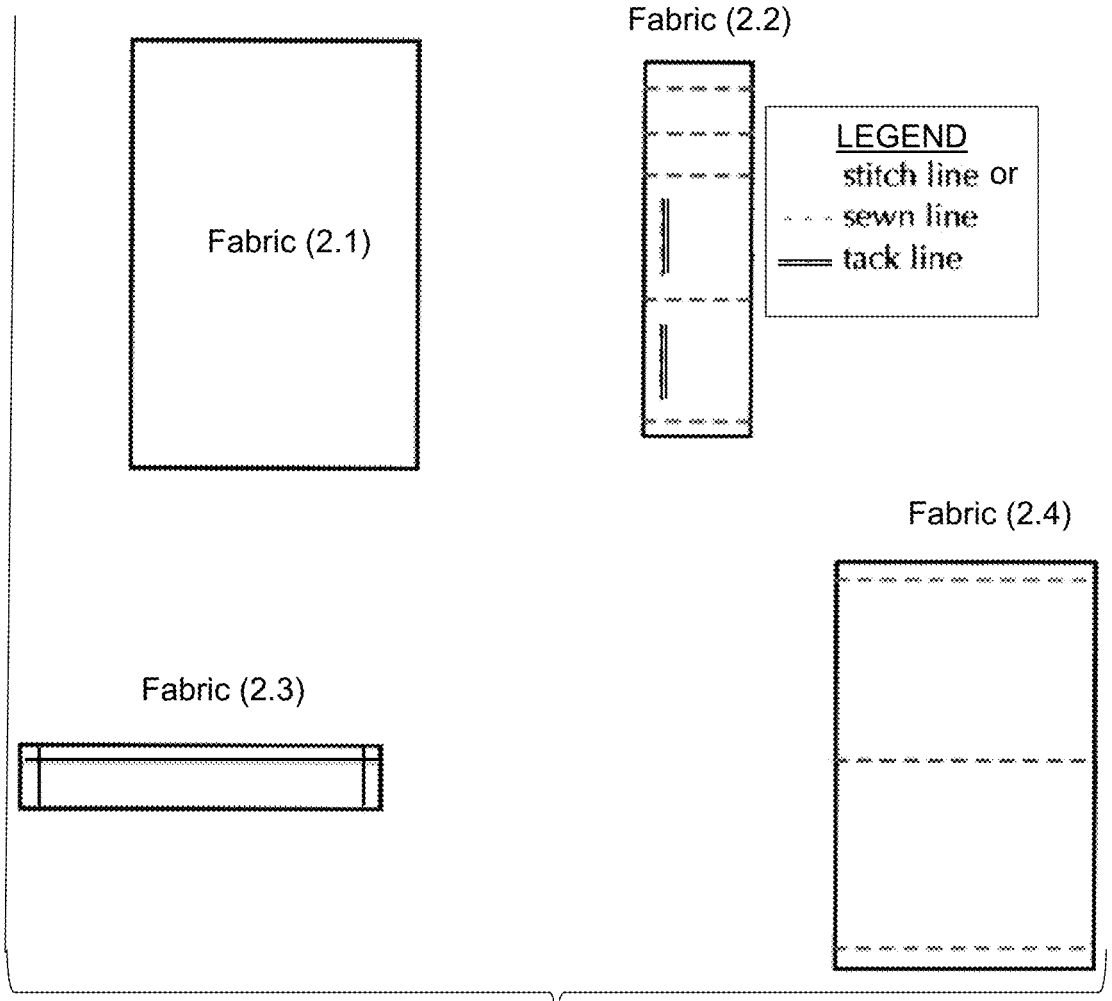
FIG. 2 includes top view of various optional fabric components that may be employed with the organizer embodiment of FIG. 1.

In a further alternative embodiment, for example as represented by the alternatives illustrated in FIG. 2, an additional fabric layer such as Fabric 2.2 or Fabric 2.4 may be affixed on a surface of any layer, for example Layers 1 and/or 3 to form at least one additional pocket between the first and third of the four layers.

Continuing to refer to the figures, the Clipboard 100 may be chosen by needed printed material size for purpose of effort. Fabric 120 is cut to enable the clipboard length (L), determined by printed document size (e.g., letter, legal, A4), and may include added material for ends or not to include added material for ends. If the latter is chosen a separate cutting step is needed to add end pieces (136, 138 in FIGS. 1 and 2). It will be appreciated that it will be important to include enough material for sewing needs.

An optional piece of fabric, for example Fabric 2.1 in FIG. 2, is cut to enable securing a fastener 130 of a size needed to secure a tablet or other electronic device and ensure the width does not exceed the clipboard width. An optional closure mechanism 140 may be sewn or otherwise attached onto fabric 120 in a manner that when all of the layers are folded over mechanism 140, such as the elastic closure band shown, will hold the Layer 4 fabric in place as a cover for the organizer—covering the documents, material and or device on Layer 2.

As previously noted, another optional piece of fabric (see Fabric 2.2 in FIG. 2) may be cut and attached to one of the layers, for example Layer 1 inside pocket 230, to enable securing of pens, pencils, business cards, etc. Fabric 2.2 may be sewn or otherwise attached onto the bottom of Layer 1 in an appropriate location (see FIG. 3C) to enable easy placement and retrieval of pens, pencils, business cards.

Figure 3A:
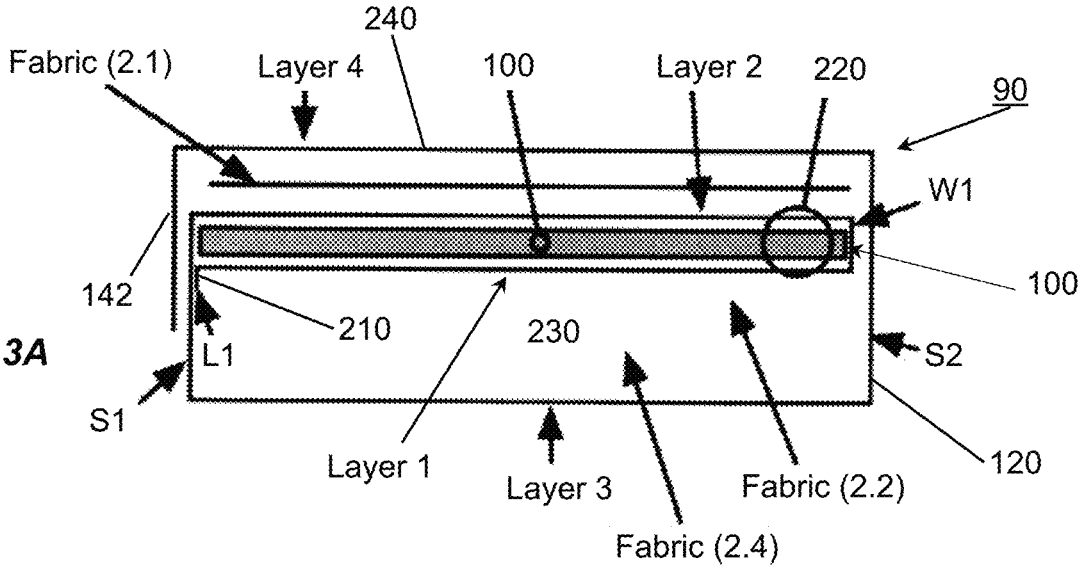
FIGS. 3A-3C are alternate side view of an embodiment of the organizer of FIG. 1.
Figure 3B:
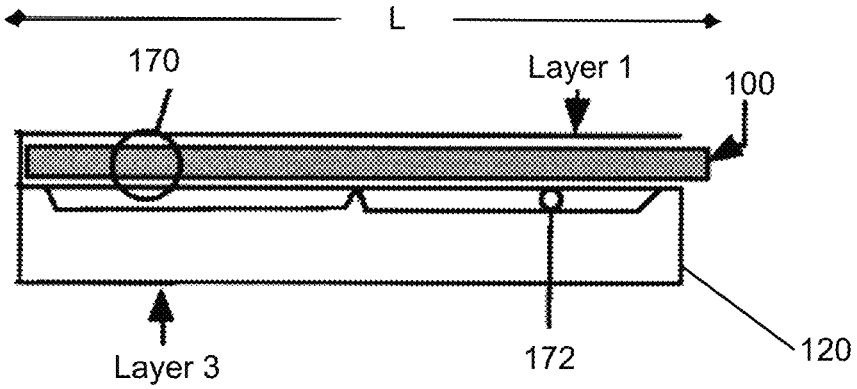
Figure 3C:
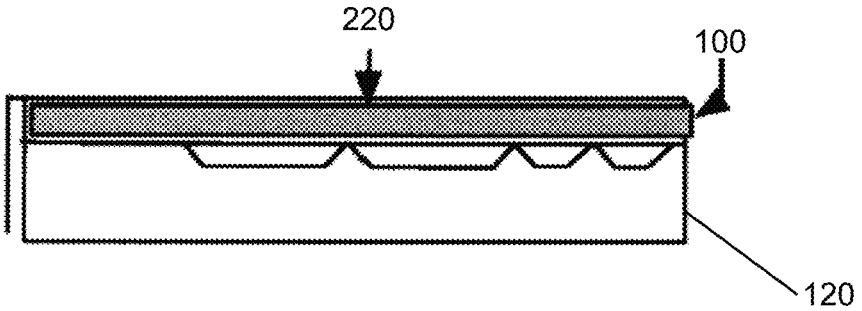
Figure 4:
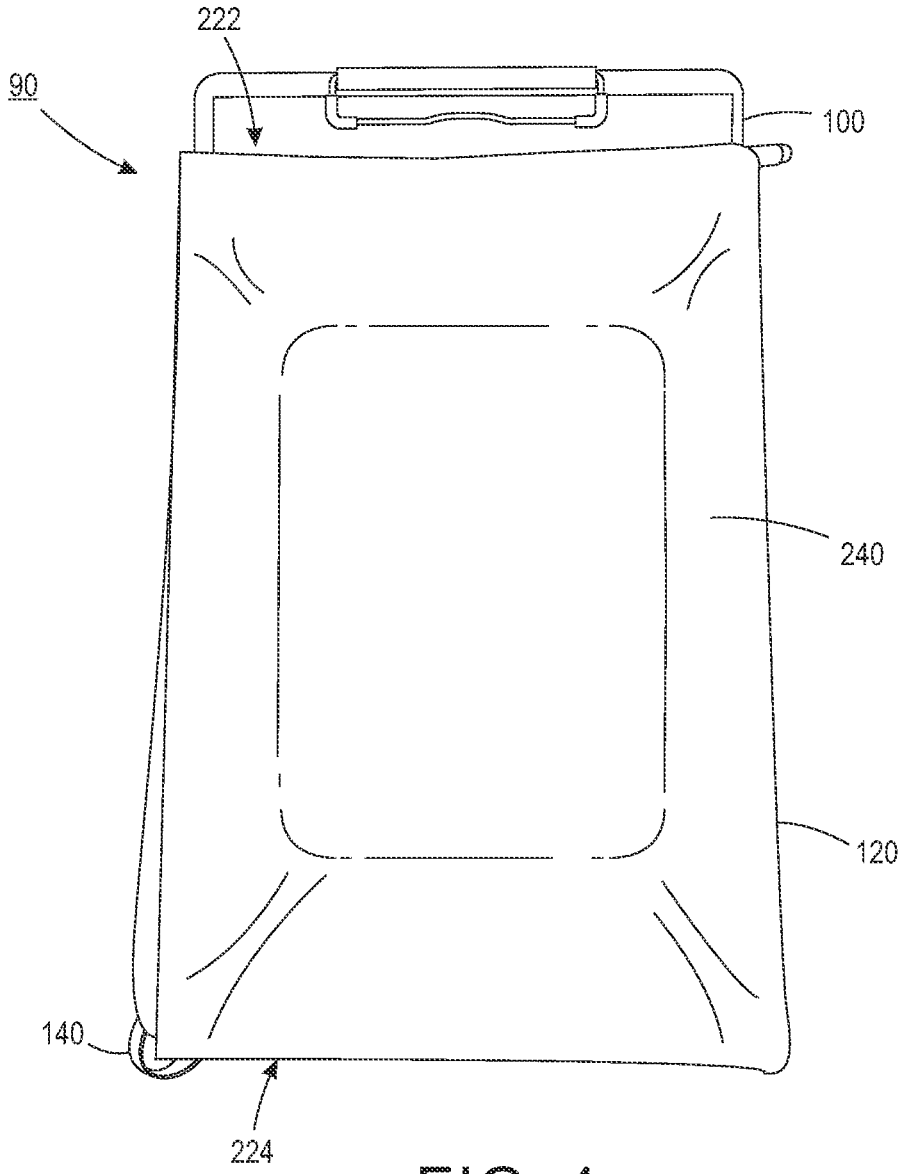
FIGS. 4-11 are illustrative images depicting an organizer in various configurations for use or access.
Figure 5:
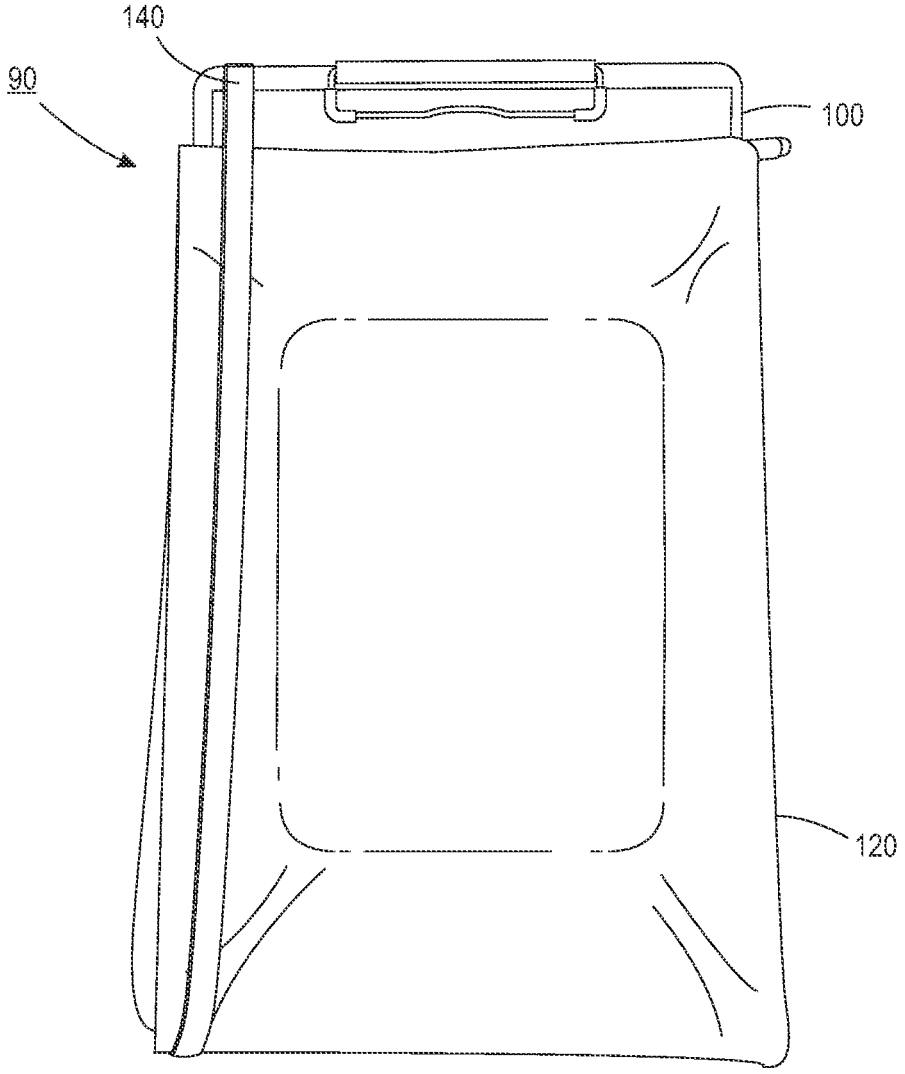
Figure 6:
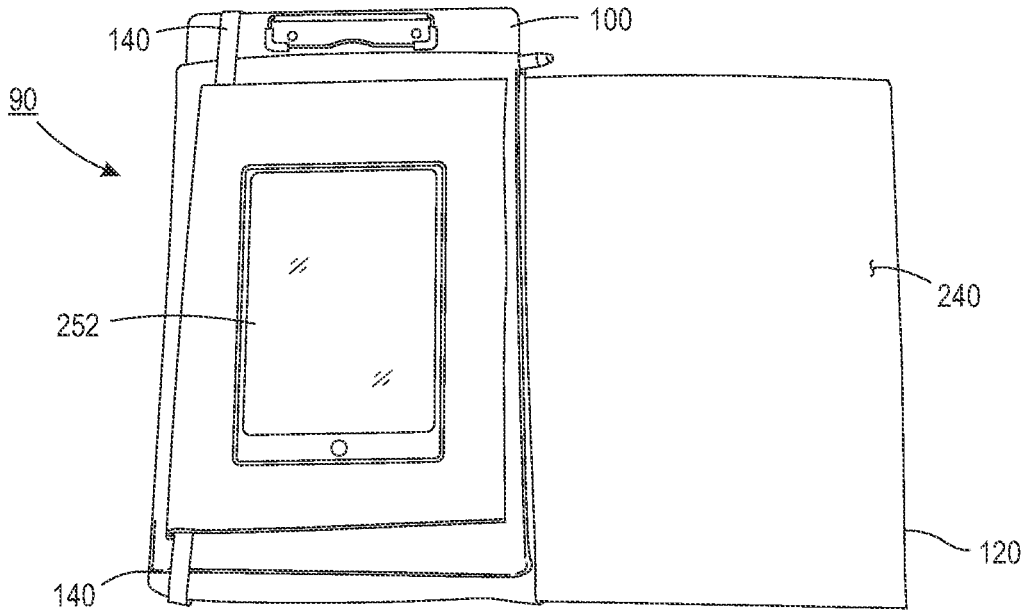
Figure 7:
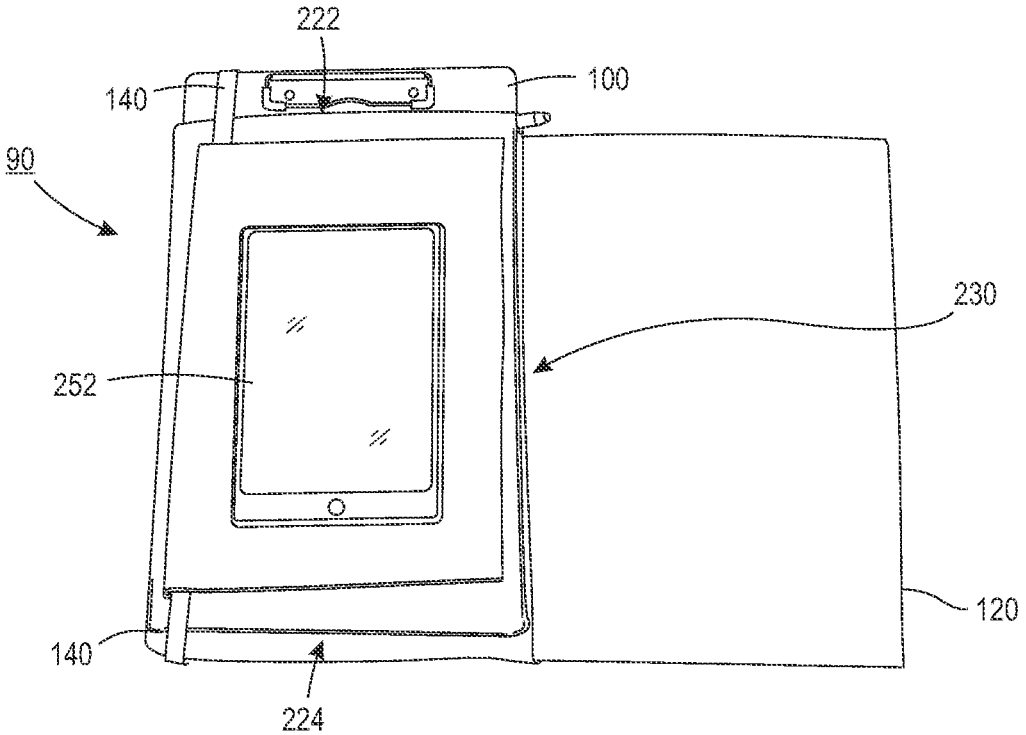
Figure 8:
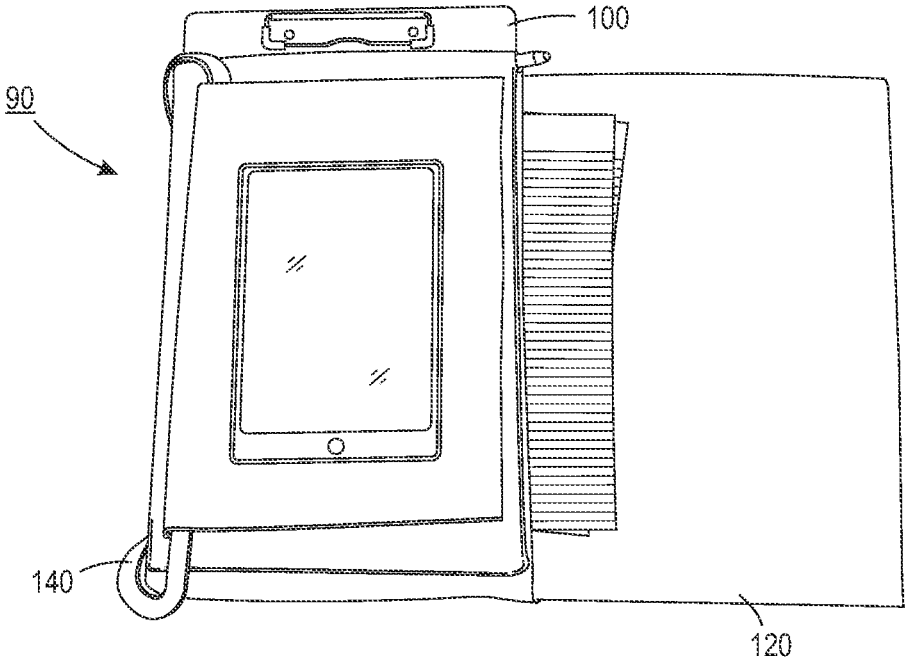
Figure 9:
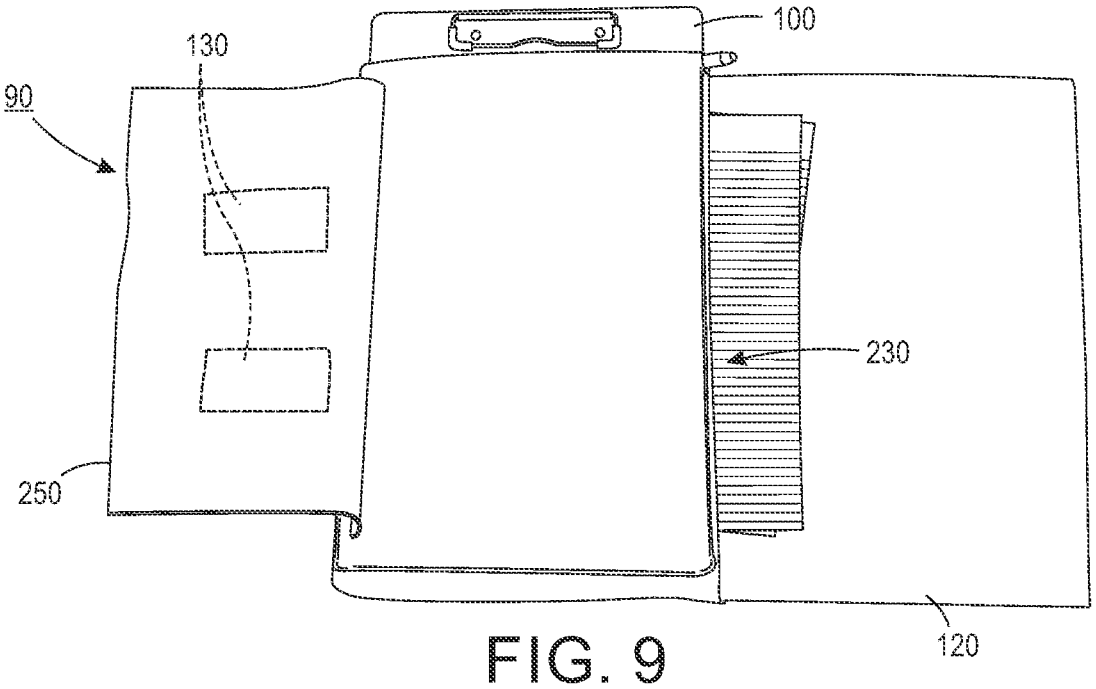
Figure 10:
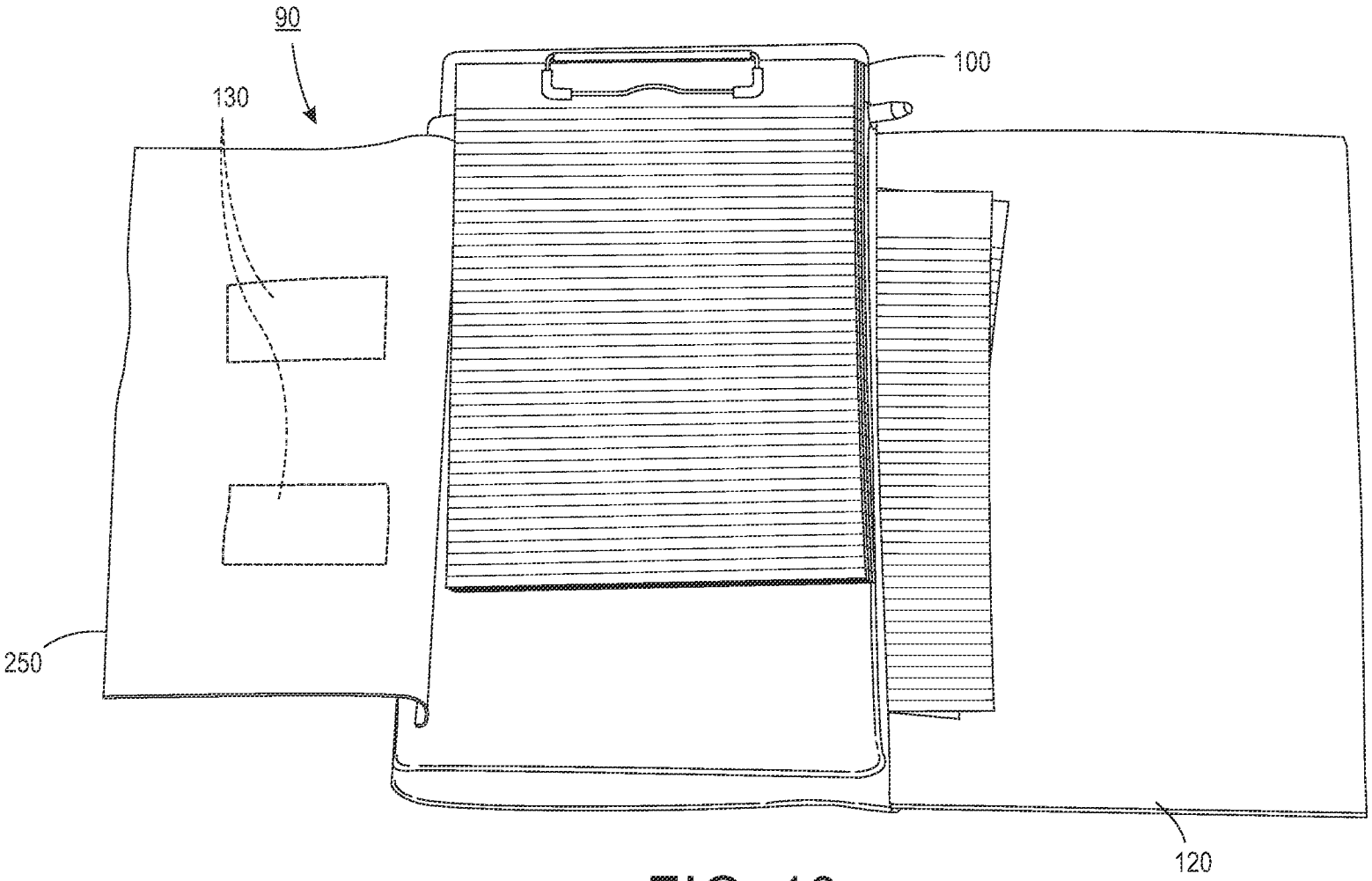
Figure 11:
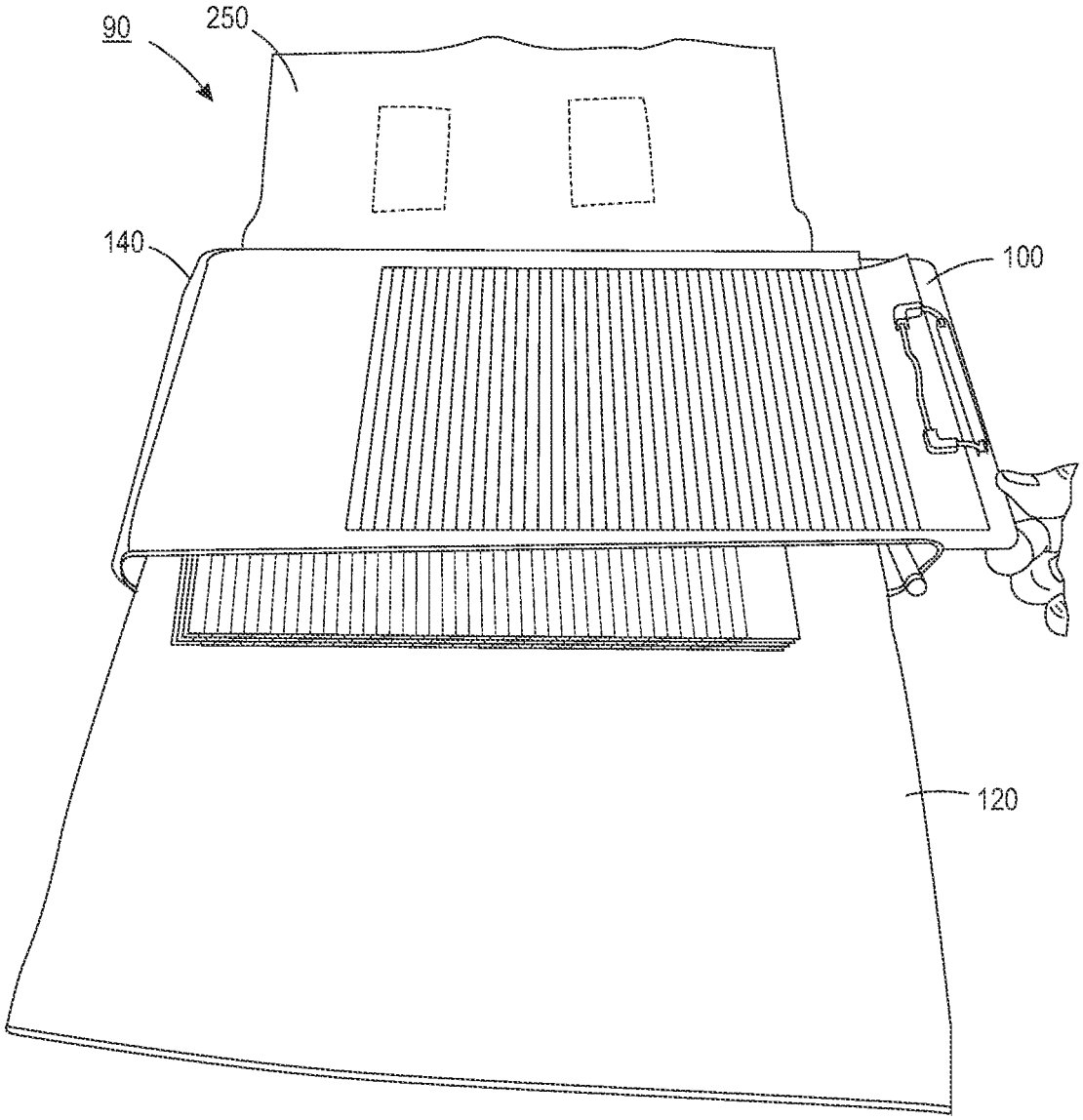

If the alternative embodiment is to not include end pieces 136, 138 in the original fabric cutting operation then two fabric pieces (Fabric 2.3 in FIG. 2) are cut and attached to create the two end pieces or flaps (136, 138 in FIG. 1), which may also include extra material along the edges to enable sewing or other attachment to the main fabric piece (Fabric 2). As illustrated in FIG. 2, another optional piece of fabric (Fabric 2.4) is cut to enable half cut document sheets, referred to as postcards or palm cards and other similarly sized objects, to be stored in separate pocket envelopes 172 as illustrated in FIG. 3B, on the underside of cavity 170. As discussed previously, the Fabric 2.4 may be sewn onto bottom of Layer 1 in an appropriate location to enable easy access (e.g., insertion or removal of cards). This can also be sewn with Fabric 2.2 in a manner that enables both to function for use. For example, Fabric 2.2 may be sewn onto the face of Fabric 2.4, which in turn may be sewn onto Layer 1, thereby providing multiple pockets of different sizes within the larger storage pocket 230.

Assembly—In one method of preparing the organizer, fabric piece 120 is cut to length to enable wrapping around a clipboard 100 several times, particularly including adequate material for sides (S1 and S2), to provide a slot 220 where the clipboard (e.g., without any paper) will slide into the pocket making a firm fit. Length can be based upon the clipboard or can be extended to accommodate a cover to protect printed material(s) or device(s).

With successive folding and sewing in correct places, an internal pocket or envelope 230 is formed where, as described above, various printed material may be stored. And, a slot 220 is formed for receiving the clipboard or other flat panel therein to provide structure or rigidity to the organizer. Depending on the user's need additional sections such as Fabric 2.1, Fabric 2.2 and/or Fabric 2.4 may be attached to provide additional pockets or for added functionality such as device holders, etc.

Lastly, if an elastic band or strap 140 is chosen as a fastener or closure mechanism, it can be used to help lock or hold down the remainder of fabric flap F1 or 144.

Assembly is accomplished by first folding the fabric 120 back on itself Layer 1 to Layer 2, encompassing 122 and L1. Next fold fabric 120 back on itself to Layer 3 encompassing S1 and 124. Bring end pieces of fabric 120 up or include the two separate end pieces of fabric (136, 138). Edges are sewn taking care to ensure top of fabric 120 has the slot 220 to enable sliding clipboard (without paper) snugly into the slot. Do not sew Layer 3 to 126, S2, or Layer 4. Invert assembly. Next, select proper clipboard, insert papers, pens, pencils or device in proper locations as needed. Wrap fabric Layer 3 to 126, S2, Layer 4, 124 over top of clipboard and ready to go. Using such a layered design and assembly technique the complete organizer can be assembled. As will be appreciated, optional components such as pieces of fabric (e.g. Fabric 2.1, Fabric 2.2 and/or Fabric 2.4) may be added during assembly (possibly prior to folding and assembling Layers 1-4, or they may be added after the layers are assembly and connected. By including one or more of the optional items the organizer may be customized to more specific needs of the user. Other options can include silk screen, iron on or other emblem printer logo transfer methods for the user's or group's desired logo, message, etc.

A person engaged in various campaign, data gathering, interview or door to door canvassing actions could use the organizer in one of the various embodiments to simplify the carrying of printed material and also if needed the carrying of a device to aide in the work. When filling out a form, signing a document, locating needed printed material or when showing or recording information from the device the disclosed organizer provides a single hand held solution, reducing the likelihood of dropping material, fumbling around looking for material and eliminates the need for carrying extra devices bags, containers, etc.

Material—various types of textiles may be used for the fabric components of the organizer. In one embodiment the textiles used may be both flexible and suitable for providing weather protection including one or more of the following characteristics: water resistant, water resilient, water impermeable, ultraviolet (UV) and fade resistant. For example, the line of Sunbrella™ materials produced by Glen Raven, Inc.

are believed to be suitable as the materials for several of the components of organizer embodiments disclosed herein.

As another alternative design of organizer 90, it is contemplated that Layer 1, forming the bottom of the clipboard slot 220, may be replaced by two or more straps or optional bands 190 as depicted in FIG. 1. Such an alternative embodiment would reduce the amount of fabric required and is believed to reduce the complexity and labor for assembly as the use of bands makes sewing the ends of the bands at the edges of Layer 2 easier. While the bands 190 may be made of a similar fabric, they may also be made of an elastic or similar expandable material so as to provide a captive slot 220 into which clipboards of slightly varying width may be inserted. The elasticity allows for size (width) variation in the clipboard and may further assure that the clipboard is retained in the slot.

It should be understood that various changes and modifications to the embodiments described herein will be apparent to those skilled in the art. Such changes and modifications can be made without departing from the spirit and scope of the present disclosure and without diminishing its intended advantages. It is therefore anticipated that all such changes and modifications be covered by the instant application.

What is claimed is:

1. An organizer, comprising:

a single piece of fabric folded along a plurality of parallel fold lines to form at least four overlapping layers, where a first of the four layers includes at least a short edge a flap on an outer edge of the single piece of fabric along the first of the four layers, where the short edge flap is permanently connected to a second of the four layers to form at least one slot between the first of the four layers and the second of the four layers, said fabric being further folded to form a third of the four layers opposite the second of the four layers, wherein opposing exposed edges on each side of the second of the four layers and the third of the four layers are operatively joined to form a permanent pocket between the second and the third of the four layers, and where the fabric is further folded to form a fourth of the four layers that provides both a removable flap, to enclose the pocket, and a cover over the second of the four layers;

a mechanism for holding said fourth of the four layers in position as a cover over the second of the four layers; and a rigid surface for removable insertion into the at least one slot for providing a surface about which the folded fabric layers may be employed.

2. The organizer according to claim 1, where said slot is open along opposed edges of the first and second of the four layers to allow insertion of the rigid surface therein from either side so as to make the organizer customizable for use from either side.

3. The organizer according to claim 1, wherein an outer surface of the second of the four layers includes at least one component facilitating the attachment of a device thereto.

4. The organizer according to claim 3, where said component facilitating attachment includes at least one element selected from the group consisting of: hook-and-loop fasteners, a fabric flap, a fabric pocket having a window for access to the device.

5. The organizer according to claim 3, wherein said device is selected from the group consisting of: a tablet, a smart phone and a processor-driven display screen.

6. The organizer according to claim 1 further including an additional fabric layer affixed on a surface of at least one of the first and third of the four layers to form at least one additional pocket between the two of the four layers.

7. The organizer according to claim 1, wherein said mechanism for holding the fourth of the four layers in place is selected from the group consisting of: a hook-and-loop type fastener, a snap, an over-wrapped elastic cord, a button, a clasp and a zipper.

8. The organizer according to claim 1, wherein said rigid surface includes a clipboard.

9. The organizer according to claim 1, wherein the fabric exhibits at least one characteristic selected from the group consisting of: water resistance, water resiliency, water impermeability, ultraviolet resistance and fade resistance.

10. The organizer according to claim 1, where the first of the four layers comprises a pair of parallel bands.

11. The organizer according to claim 10, where the pair of parallel bands are formed of an elastic material.

* * * * *